US005785206A

United States Patent [19]

Chan

[11] Patent Number: 5,785,206

[45] Date of Patent: Jul. 28, 1998

[54] DISPENSER FOR CANDIES OR THE LIKE

[75] Inventor: Pak Nin Chan, Kowloon, Hong Kong

[73] Assignee: Candy Novelty Works Ltd., Kowloon, Hong Kong

[21] Appl. No.: 733,975

[22] Filed: Oct. 18, 1996

[51] Int. Cl.[6] ..... G07F 11/16

[52] U.S. Cl. ..... 221/271; 221/232; 221/269; 221/198; 267/158; 267/163

[58] Field of Search ..... 221/232, 268, 221/269, 270, 271, 198; 267/158, 159, 160, 163

[56] References Cited

U.S. PATENT DOCUMENTS

| | | | |
|---|---|---|---|
| 2,245,066 | 6/1941 | Bouchard | 221/232 |
| 2,705,576 | 4/1955 | Amelio et al. | 221/232 |
| 3,270,915 | 9/1966 | Auer | 221/2 |
| 3,422,991 | 1/1969 | MacDougall et al. | 221/232 |
| 3,471,056 | 10/1969 | Kovac | 221/232 |
| 3,515,111 | 6/1970 | Auge | 124/16 |
| 4,489,853 | 12/1984 | Korte et al. | 221/235 |
| 4,589,575 | 5/1986 | Rigberg et al. | 221/198 |
| 4,909,275 | 3/1990 | Massey et al. | 267/158 |
| 4,966,305 | 10/1990 | Hinterreiter | 221/229 |
| 5,178,298 | 1/1993 | Allina | 221/24 |

FOREIGN PATENT DOCUMENTS

| | | | |
|---|---|---|---|
| 1512277 | 5/1978 | United Kingdom | B65D 83/04 |

*Primary Examiner*—William E. Terrell
*Assistant Examiner*—Khoi H. Tran
*Attorney, Agent, or Firm*—Joan H. Pauly

[57] ABSTRACT

The body of a dispenser includes a compartment (C) configured to receive a stack of pellets (P). A dispensing slot (S) is located at one end of the compartment (C). A spring biases the pellets (P) toward the slot (S). A lever (50) has a rest position in which it blocks movement of pellets (P) into the slot (S), and a cocked position in which it allows a pellet (P) to move into the slot (S). The lever (50) is biased into the rest position by a J-shaped leaf spring (64). The spring (64) has a curved end arcing around the pivot axis (X) of the lever (50) and a straight end (68). A stop (70) engages the straight end (68) to allow translation but prevent pivoting of the straight end (68) when the lever (50) is pivoted away from its rest position.

11 Claims, 3 Drawing Sheets

FIG. 5
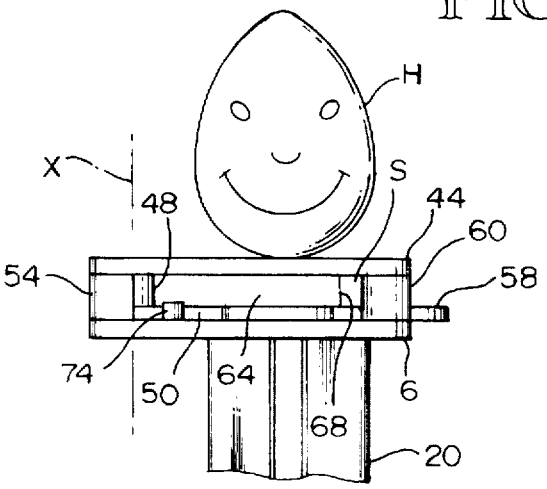
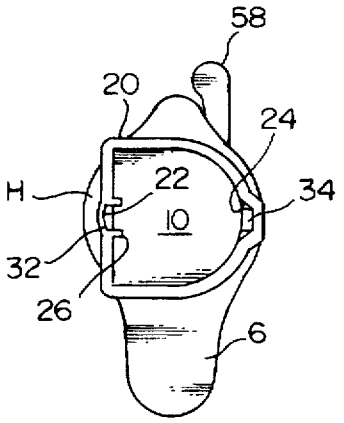
FIG. 6
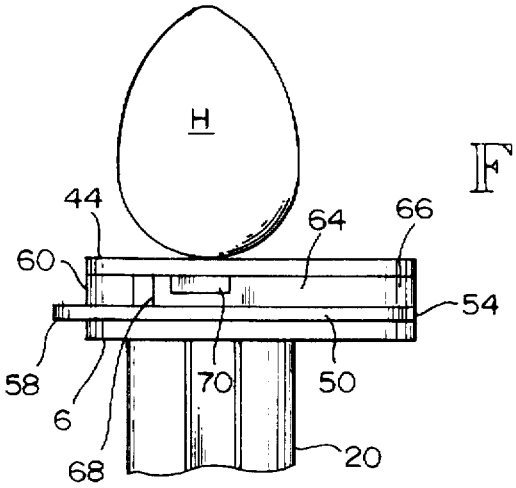
FIG. 7
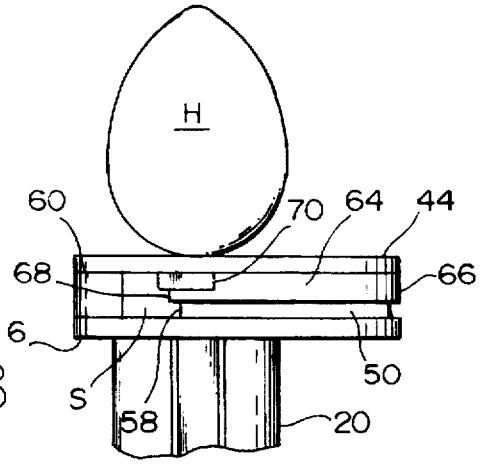
FIG. 8

DISPENSER FOR CANDIES OR THE LIKE

TECHNICAL FIELD

This invention relates to a dispenser for candy pellets or the like and, more particularly, to such a dispenser in which individual pellets are forcibly propelled from the dispenser by a lever spring biased by a J-shaped leaf spring.

BACKGROUND INFORMATION

Dispensers for pellet-like pieces of candy are well-known and have been popular for a number of years. Such dispensers allow the candy to be dispensed one piece at a time onto the user's hand. Candy dispensers are disclosed in U.S. Pat. Nos. 3,515,111, granted Jun. 2, 1970, to P. Auge; No. 4,589,575, granted May 20, 1986, to A. Rigberg et al.; No. 4,966,305, granted Oct. 30, 1990, to I. Hinterreiter; and No. 5,178,298, granted Jan. 12, 1993, to C. J. Allina. Dispensers for dispensing pills or tablets are disclosed by U.S. Pat. Nos. 2,705,576, granted Apr. 5, 1955, to A. F. Amelio. et al. and No. 3,270,915, granted Sep. 6, 1966, to J. R. Auer. U.S. Pat. No. 3,422,991, granted Jan. 21, 1969, to I. C. MacDougall et al., discloses a dispenser for heat accumulative pellets.

SUMMARY OF THE INVENTION

The present invention is directed toward a dispenser for pellets. According to an aspect of the invention, the dispenser comprises a body including a compartment configured to receive a stack of pellets, and a dispensing slot located at one end of the compartment and having a side opening. A spring is positioned to bias the stack toward said one end of the compartment. A dispensing lever has a rest position and a cocked position. In the rest position, the lever is substantially in the slot and adjacent to the side opening and acts against the force of the spring to block movement of the pellets into the slot. In the cocked position, the lever is moved away from the side opening to allow one of the pellets to move into a dispensing position in the slot and adjacent to the side opening. The lever is mounted on the body to pivot about a pivot axis between the rest position and the cocked position. A substantially J-shaped leaf spring is positioned to bias the lever into its rest position. The leaf spring has a curved end secured to the lever and arcing around the axis, and an opposite end. A stop is carried by the body and is positioned to engage the opposite end of the leaf spring when the lever is pivoted from its rest position to its cocked position. This allows the opposite end of the leaf spring to move linearly toward the axis but prevents the opposite end from pivoting about the axis. When the lever is released from its cocked position, the leaf spring moves the lever into its rest position to propel a pellet in the slot out of the dispenser through the side opening.

Preferably, the curved end of the leaf spring is secured to an end portion of the lever, and the curved end and the lever end portion together form an end member. The dispenser further comprises a stop pin projecting into the slot and positioned to engage the end member to limit movement of the lever toward its cocked position and arcing of the curved end of the leaf spring around the axis. Also preferably, the lever includes a notch positioned adjacent to the axis to receive the stop pin when the lever moves toward the rest position.

Another preferred feature of the invention is a stop post extending across an end of the slot opposite the pivot axis. The stop post is positioned to engage the lever to limit movement of the lever toward its rest position.

In the preferred embodiment, the stop for the opposite end of the leaf spring projects into the slot adjacent to the opposite end. In its rest position, the lever is substantially parallel to the spring's opposite end. The lever slides between the end of the compartment adjacent to the slot and the opposite end of the leaf spring when it pivots from its rest position to its cocked position.

The structure of the body of the dispenser may be varied. In the preferred embodiment, the body includes an inner shell and an outer sleeve. The inner shell receives the stack of pellets. The shell has a first end portion adjacent to the slot, a base that defines and closes an end of the compartment opposite the slot, and an open side. The outer sleeve is slidable on the shell to expose and cover the open side. The base has a pair of notches adjacent to the open side. The shell has a pair of elongated ribs positioned to slide in the pair of notches when the sleeve slides relative to the shell.

The parts of the dispenser may be made from a variety of materials. In the preferred form, the J-shaped leaf spring and the lever are made from molded plastic.

The invention provides a design for a dispenser that is an improvement over the previously known designs. The dispenser of the invention has a number of advantages. These advantages include economy of manufacture, durability, and reliability in operation. They also include the capability of being embodied in a dispenser having an attractive appearance.

These and other advantages and features will become apparent from the detailed description of the best mode for carrying out the invention that follows.

BRIEF DESCRIPTION OF THE DRAWINGS

In the drawings, like element designations refer to like parts throughout, and:

FIG. 5 is a front elevational view of the top portion of the dispenser shown in FIGS. 1–4.

FIG. 6 is a bottom plan view of the dispenser shown in FIGS. 1–5.

FIG. 7 is a rear elevational view of the top portion of the dispenser shown in FIGS. 1–6 illustrating the lever in its rest position.

FIG. 8 is like FIG. 7 except that it shows the lever in its cocked position.

BEST MODE FOR CARRYING OUT THE INVENTION

Figure 1:
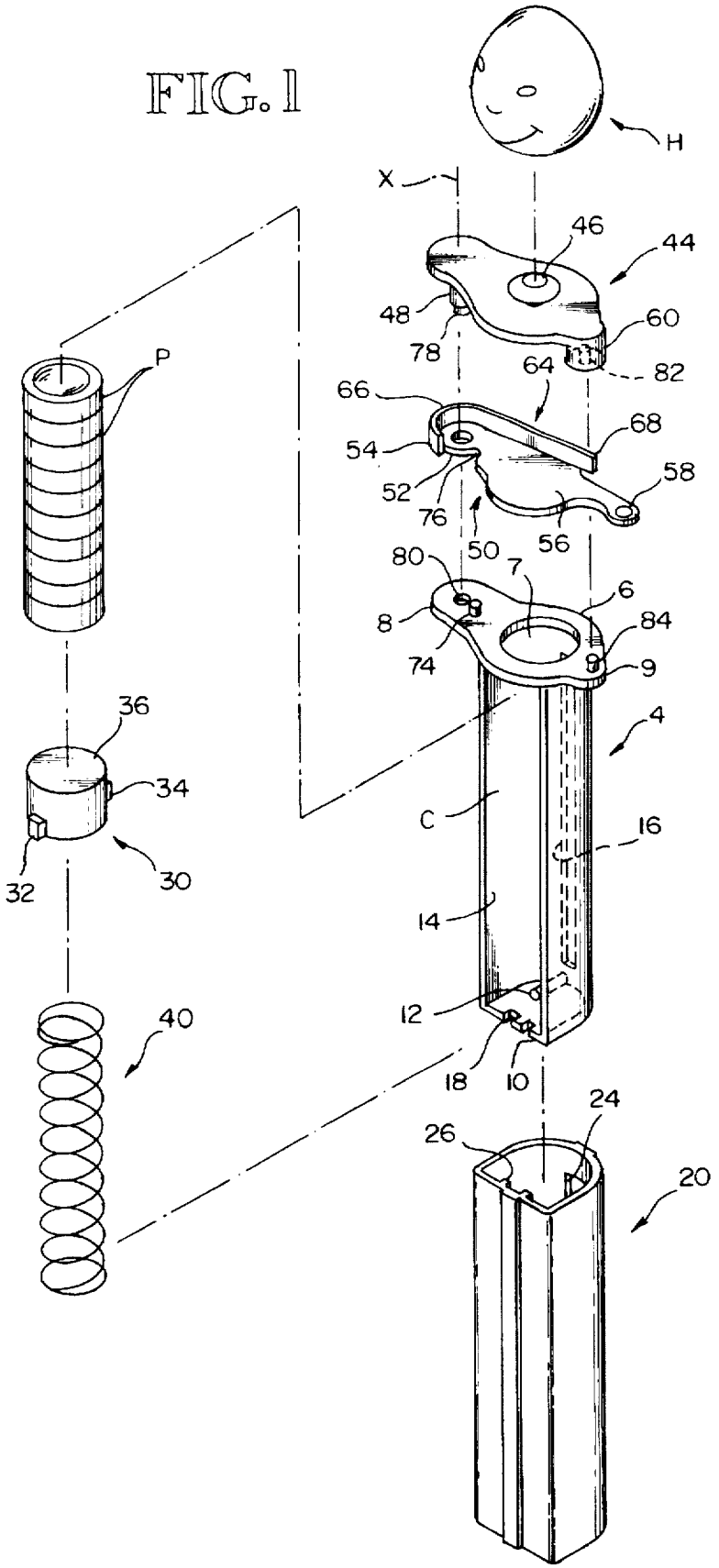
FIG. 1 is an exploded pictorial view of the preferred embodiment of the dispenser and a plurality of pellets.

The drawings show a dispenser 2 that is constructed according to the invention and that constitutes the best mode for carrying out the invention currently known to the applicant. The dispenser of the invention is intended primarily for dispensing pieces P of candy and for use by children. However, the dispenser may also be used for dispensing other types of pellets, including but not limited to pills and tablets, and may be used by adults as well as children. As shown in the drawings, the dispenser 2 has a body on which a head H is mounted. The head H is shown in a generic form. It is anticipated that, in actual use, the dispenser 2 will include a head that is attractive to children, such as a head representing a popular fictional character.

Figure 2:
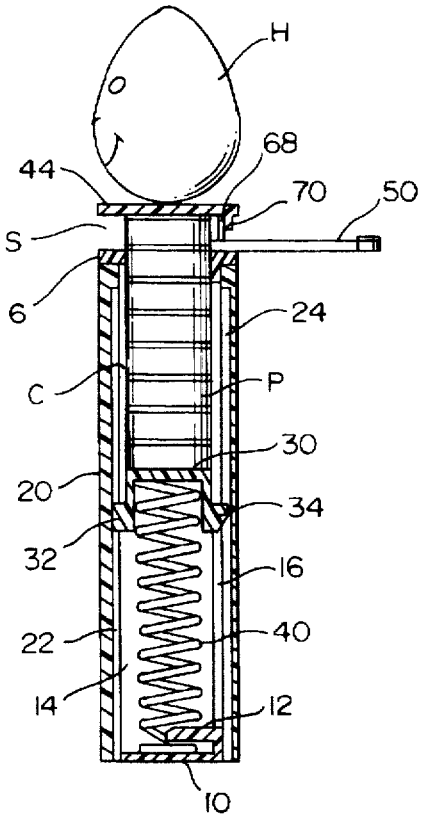
FIG. 2 is an assembled sectional view of the dispenser and pellets shown in FIG. 1, with parts shown in elevation.

Referring to FIGS. 1 and 2, the dispenser body includes an inner shell 4 and an outer sleeve 20. The shell 4 has a U-shaped cross section. An elongated upper flange 6 is mounted on a first open end of the shell 4. The flange 6 includes a first large side projection 8 and a second opposite smaller side projection 9. These projections 8, 9 serve as mounting portions, as described further below. The flange 6 also has a center circular opening 7 extending therethrough in alignment with the space defined by the shell 4. The opening 7 is configured and dimensioned to be slightly larger than a round pellet P of candy for which the illustrated embodiment is designed. The cross section of the shell 4 and the shape and size of the opening 7 may be modified to accommodate other sizes and configurations of pellets without departing from the spirit and scope of the invention.

The end of the inner shell 4 opposite the flange 6 is closed by an end wall 10. A spring post 12 extends from a sidewall of the shell 4 parallel to and spaced a small distance above the end wall 10. The post 12 extends toward the open side 14 of the U-shaped shell 4. Its attached end is positioned adjacent to the base of a longitudinal slot 16 that extends along the sidewall of the shell 4 opposite the open side 14 upwardly to a location proximate to but spaced from the flange 6. The end wall 10 has a pair of small notches 18 extending therethrough adjacent to the open side 14. These notches 18 engage ribs 26 on the outer sleeve 20, as shown in FIG. 6 and described further below.

The outer sleeve 20 is slidable on the shell 4 to expose and cover the open side 14 of the shell 4. To accommodate the shell 4, the sleeve 20 has a cross section complementary to the shell's cross section. The sleeve cross section has a closed side opposite its U-shaped portion to completely enclose the shell 4 and cover the open side 14 when the dispenser is in the closed use position shown in FIGS. 2–4. Each of the opposite ends of the sleeve 20 are open. First and second opposite elongated channels 22, 24 extend along inner wall surfaces of the sleeve 20. Each channel 22, 24 extends from an open bottom, shown in FIG. 6, to a closed upper end. The first channel 22 is positioned to be adjacent to the open side 14 of the shell 4 when the dispenser 2 is assembled into its use position. The second channel 24 is opposite to and confronts the first channel 22 and extends along the curved apex of the U-shaped portion of the sleeve sidewall.

The ribs 26 mentioned above extend longitudinally along the inner surface of the sleeve 20 at the opposite edges of the first channel 22. The ribs 26 have a limited height, for example about 0.10 centimeters, and are received in the correspondingly shallow notches 18 on the end wall 10 of the shell 4. The engagement of the ribs 26 in the notches 18 guides sliding movement of the sleeve 20 relative to the shell 4 and helps assure that such movement is smooth to facilitate loading the dispenser 2 with candy pellets P. The ribs 26 also increase the effective depth of the channel 22 and help to retain the stack of pellets P in position closely adjacent to the curved apex of the U-shaped portion of the sleeve sidewall.

The dispenser 2 includes a slidable cup-shaped spring abutment 30. The abutment 30 is received into the inner shell 4. A first substantially rectangular side projection 32 on the abutment 30 is positioned to extend radially through the open side 14 and into the first channel 22 on the inner surface of the outer sleeve 20. A second side projection 34 opposite the first projection 32 is positioned to extend radially through the longitudinal slot 16 in the shell 4 and into the second channel 24 of the outer sleeve 20. The second projection 34 has a radial extent greater than that of the first projection 32 and terminates in an outer end surface that tapers radially inwardly and downwardly. The tapered surface facilitates assembly of the dispenser 2. Engagement of the projections 32, 34 with the closed upper ends of the channels 22, 24 limits movement of the abutment 30 relative to the sleeve 20 to prevent passage of the abutment 30 out of the shell 4 through the center opening 7 in the upper flange 6 and to retain the abutment 30 in a position substantially within the sleeve 20.

Sliding movement of the projections 32, 34 in the slot 16 and channels 22, 24 guides movement of the abutment 30 relative to the shell 4 and helps prevent tilting of the abutment 30. The abutment 30 has an upper support surface 36 configured to support a stack of pellets P, as shown in FIG. 2. The surface 36 and the diameter of the abutment 30 are designed to be slightly smaller than the opening 7 to permit the surface 36 to move upwardly into a position substantially flush with the top surface of the flange 6.

A coil spring 40 is positioned in the shell 4 to bias the abutment 30 upwardly toward the flange 6. The lower end of the spring 40 is hooked around the free end of the spring post 12 to anchor the spring 40. The opposite end of the spring 40 extends into the cup-shaped abutment 30. Thus, the end wall 10/spring post 12 and the inner bottom surface of the cup-shaped abutment 30 serve as abutments for the opposite ends of the spring 40. Movement of the sleeve 20 downwardly relative to the shell 4 and away from the upper flange 6 compresses the spring 40 between its opposite abutments and exposes the open side 14 of the shell 4.

To load the dispenser 2, the sleeve 20 is moved downwardly relative to the shell 4 as far as it will go. This compresses the spring 40 and exposes the open side 14 of the shell 4. Then, a stack of pellets P is inserted into the shell 4 through the open side 14. Once the pellets P are positioned, the shell 4 and sleeve 20 are manually returned to their use positions shown in FIGS. 2–4. In this position, the shell 4 and the sidewall of the sleeve 20 adjacent to the shell's open side 14 together form a compartment C configured to receive and retain a stack of pellets P. The flange 6 is positioned at and partially defines the top of the compartment C.

The body of the dispenser 2 further includes a top plate 44 having essentially the same plan form as the upper flange 6 except for the absence of a center opening. The top plate 44 is mounted on and spaced above the flange 6 in parallel alignment therewith so that a dispensing slot S is defined therebetween. The slot S has a height slightly greater than the thickness of an individual pellet. Preferably, the upper surface of the plate 44 has a mounting stud 46 formed thereon for mounting a head H on the dispenser body. A pivot post 48 defining a pivot axis X extends downwardly from the larger side projection of the plate 44 adjacent the end thereof toward the flange 6. A reduced diameter end portion 78 of the post 48 forms a stud 78 that is received into a corresponding opening 80 in the flange 6 to form part of the attachment of the plate 44 to the flange 6.

Candy pellets P are dispensed from the dispenser 2 by means of a lever 50. The lever 50 has a first pivot end 52 that is pivotably attached to the pivot post 48 to pivotably mount the lever 50 on the dispenser body. The lever 50 is a substantially flat thin member with an enlarged attachment portion 54 formed on the pivot end 52. The attachment portion 54 extends perpendicularly beyond the plane of the main flat portion of the lever 50. The flat lever body also includes a laterally enlarged center portion 56 and a reduced width actuator end 58 opposite the pivot end 52. The actuator end 58 extends out of the slot S and beyond the body of the dispenser 2 to permit engagement by the thumb or finger of the user of the dispenser 2.

Figure 3:
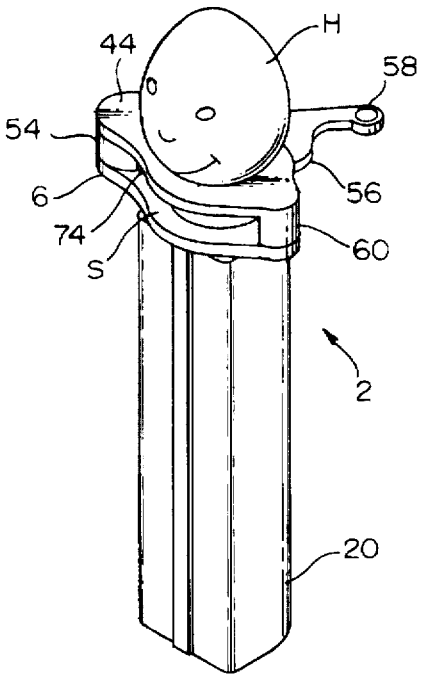
FIG. 3 is a pictorial view of the dispenser shown in FIGS. 1 and 2 illustrating the lever in a cocked position.

The lever 50 has a rest position in which it is substantially in the slot S and adjacent to a side opening of the slot and acts against the force of the spring 40 to block movement of candy pellets P into the slot S through the center opening 7 in the upper flange 6. The lever 50 also has a cocked position in which it is moved away from the side opening of the slot S to allow one of the pellets P to move into a dispensing position in the slot S adjacent to the slot's side opening. The pivotable attachment of the pivot end 52 of the lever 50 to the pivot post 48 mounts the lever 50 on the dispenser body to pivot about the pivot axis X between the rest position and the cocked position. The lever 50 is spring biased into its rest position. FIGS. 4–7 illustrate the rest position. FIGS. 2, 3, and 8 illustrate the cocked position.

A stop post 60 extends across the end of the slot S opposite the pivot axis X and is positioned to engage the actuator end 58 of the lever 50 to limit movement of the lever 50 toward the rest position. As illustrated, the stop post 60 has a cylindrical configuration, but the configuration of the post 50 may be varied without departing from the spirit and scope of the invention. As shown in FIG. 1, a lower opening 82 is formed in the bottom end of the stop post 60. This opening 82 is configured to receive a corresponding stud 84 on the smaller side projection 9 of the flange 6. The engagement of the stud 84 in the opening 82 cooperates with the engagement of the extension 78 in the opening 80 to mount the top plate 44 onto the flange 6. Preferably, the connections are reinforced by an adhesive.

The spring biasing of the lever 50 is provided by a J-shaped leaf spring 64. The spring 64 is mounted perpendicularly to and between the upper flange 6 and the top plate 44. A first curved end 66 of the spring 64 is secured to the lever 50 and arcs around the pivot axis X. The straight opposite end 68 of the spring 64 extends along a side edge portion of the slot S opposite the open side of the slot S and toward the stop post 60. A rectangular stop 70 extends downwardly from the undersurface of the top plate 44 into the slot S adjacent to the outwardly facing flat surface of the straight end 68 of the spring 64. The stop 70 is positioned to engage the straight end 68 of the spring 64 when the lever 50 is pivoted by a user from its rest position to its cocked position. The engagement of the spring end; 68 by the stop 70 allows the end 68 to move linearly toward the axis X but prevents the end 68 from pivoting about the axis X. See FIGS. 7 and 8. Limiting the spring end 68 to translating movement causes the degree to which the curved end 66 arcs around the axis X to increase to store energy in the spring 64.

Figure 4:
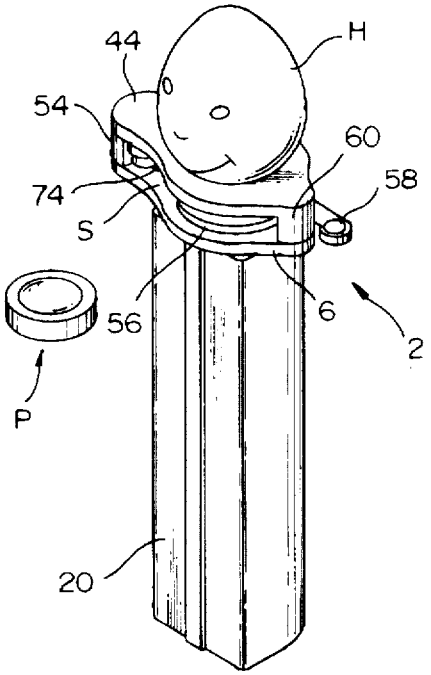
FIG. 4 is like FIG. 3 except that it shows the lever after it has been released and has propelled a pellet out from the dispenser.

When the lever 50 is released from its cocked position, the stored energy in the spring 64 moves the lever 50 back into its rest position. Movement of the lever 50 into the rest position causes the lever 50 to engage the pellet P that moved up into the slot S upon cocking of the lever 50. The spring action of the lever 50 results in sudden engagement of the pellet P by the lever 50 to propel the pellet P out of the dispenser 2 through the side opening of the slot S, as illustrated in FIG. 4. The pellet P may be dispensed into the user's or another's hand or directly into the user's mouth. Therefore, the dispenser 2 can be operated using only one hand.

As noted above, the curved end 66 of the leaf spring 64 is secured to the lever 50. In the illustrated preferred embodiment, the outer edge of the curved end 66 is secured to the attachment portion 54 of the lever 50. The curved end 66 and attachment portion 54 together form an end member. The dispenser 2 further includes a stop pin 74 projecting upwardly into the slot S from the flange 6. The stop pin 74 is positioned to engage the end member 54, 66 to limit movement of the lever 50 toward the cocked position and also limit arcing of the curved end 66 of the spring 64 around the axis X. As shown, the attachment portion 54 in effect forms a continuation of the arcing of the curved end 66 about the axis X, and the edge of the attachment portion 54 opposite the attachment to the spring's curved end 66 directly engages the stop pin 74. Preferably, the lever 50 includes a notch 76 positioned adjacent to the axis X to receive the stop pin 74 when the lever 50 moves toward its rest position.

In its rest position, the lever 50 extends through the slot S substantially parallel to the straight end 68 of the spring 64. As the lever 50 pivots about its axis X, it slides between the upper flange 6 and the straight end 68 of the spring 64. This arrangement positions the center portion 56 of the lever 50 closely adjacent to the flange center opening 7 to effectively block movement of pellets P into the slot S when the lever 50 is in its rest position. At the same time, the thickness of the lever is maintained at a fraction of the thickness of an individual pellet P. When the lever 50 is in its rest position, the edge of the lever 50 opposite the open side of the slot S is substantially flush with the flat perpendicular surface of the straight end 68 of the spring 64 to provide a compact structure and neat appearance. The lever 50 and spring 64 in effect close the rear side of the slot S opposite the open side.

The various parts of the dispenser 2 may be made from various materials. However, the parts of the dispenser 2, with the exception of the spring 40, are preferably made from molded plastic. The dispenser body is preferably three pieces of molded plastic assembled together. The first piece includes the inner shell 4 integrally molded with the upper flange 6.

The second piece is the outer sleeve 20. The third piece is the top plate 44. The spring 40 in the preferred embodiment is an ordinary metal coil spring. The J-shaped leaf spring 64 and the lever 50 are also each preferably made from molded plastic. The attachment of the curved end 66 of the spring 64 to the lever 50 may be accomplished by an adhesive or some other known bonding procedure. Alternatively, the spring 64 and the lever 50 may be integrally molded as a single piece. Suitable materials for the spring 64 include polycarbonate, high impact polystyrene, and ABS (acrylonitrile butadiene styrene) resin.

As used herein, the terms "upwardly", "downwardly", and the like refer to the use position illustrated in FIGS. 2–4. The terms are used to facilitate description of the invention and are not intended to limit the scope of the invention or to limit the dispenser to any particular orientation.

Although the preferred embodiment of the invention has been illustrated and described herein, it is intended to be understood by those skilled in the art that various modifications and omissions in form and detail may be made without departing from the spirit and scope of the invention as defined by the following claims.

What is claimed is:

1. A dispenser for pellets, comprising:

a body including, a compartment configured to receive a stack of pellets, and a dispensing slot located at one end of said compartment and having a side opening;

a spring positioned to bias said stack toward said one end of said compartment;

a dispensing lever having a rest position in which it is substantially in said slot and adjacent to said side opening and acts against the force of said spring to block movement of said pellets into said slot, and a cocked position in which it is moved away from said side opening to allow one of said pellets to move into a dispensing position in said slot and adjacent to said side opening, said lever being mounted on said body to pivot about a pivot axis between said rest position and said cocked position;

a substantially J-shaped leaf spring positioned to bias said lever into said rest position and having a curved end secured to said lever and arcing around said axis, and an opposite end; and a stop carried by said body and positioned to engage said opposite end when said lever is pivoted from said rest position to said cocked position, to allow said opposite end to move linearly toward said axis but prevent said opposite end from pivoting about said axis;

wherein, when said lever is released from said cocked position, said leaf spring moves said lever into said rest position to propel a pellet in said slot out of the dispenser through said side opening.

2. The dispenser of claim 1, wherein said curved end of said leaf spring is secured to an end portion of said lever, and said curved end and said end portion together form an end member; and wherein the dispenser further comprises a stop pin projecting into said slot and positioned to engage said end member to limit movement of said lever toward said cocked position and arcing of said curved end around said axis.

3. The dispenser of claim 2, wherein said lever includes a notch positioned adjacent to said axis to receive said stop pin when said lever moves toward said rest position.

4. The dispenser of claim 3, further comprising a stop post extending across an end of said slot opposite said pivot axis and positioned to engage said lever to limit movement of said lever toward said rest position.

5. The dispenser of claim 2, further comprising a stop post extending across an end of said slot opposite said pivot axis and positioned to engage said lever to limit movement of said lever toward said rest position.

6. The dispenser of claim 5, wherein said stop projects into said slot adjacent to said opposite end of said leaf spring, said lever in said rest position is substantially parallel to said opposite end, and said lever slides between said one end of said compartment and said opposite end of said leaf spring when it pivots from said rest position to said cocked position.

7. The dispenser of claim 2, wherein said stop projects into said slot adjacent to said opposite end of said leaf spring, said lever in said rest position is substantially parallel to said opposite end, and said lever slides between said one end of said compartment and said opposite end of said leaf spring when it pivots from said rest position to said cocked position.

8. The dispenser of claim 2, wherein said J-shaped leaf spring and said lever are made from molded plastic.

9. The dispenser of claim 1, wherein said stop projects into said slot adjacent to said opposite end of said leaf spring, said lever in said rest position is substantially parallel to said opposite end, and said lever slides between said one end of said compartment and said opposite end of said leaf spring when it pivots from said rest position to said cocked position.

10. The dispenser of claim 1, in which said body includes an inner shell that receives said stack of pellets and has a first end portion adjacent to said slot, a base that defines and closes an end of said compartment opposite said one end of said compartment, and an open side; and an outer sleeve slidable on said shell to expose and cover said open side; said base having a pair of notches adjacent to said open side, and said sleeve having a pair of elongated ribs positioned to slide in said pair of notches when said sleeve slides relative to said shell.

11. The dispenser of claim 1, wherein said J-shaped leaf spring and said lever are made from molded plastic.

* * * * *

UNITED STATES PATENT AND TRADEMARK OFFICE

CERTIFICATE OF CORRECTION

PATENT NO. : 5,785,206
DATED : July 28, 1998
INVENTOR(S) : Pak Nin Chan

It is certified that error appears in the above-identified patent and that said Letters Patent is hereby corrected as shown below:

In column 4, line 14, there should be no paragraph break.

In column 5, line 48, delete the semicolon after "spring end".

In column 6, line 39, there should be no paragraph break.

In claim 1, column 6, line 63, delete the comma following "including".

Signed and Sealed this

Fourth Day of May, 1999

*Attest:*

Q. TODD DICKINSON

*Attesting Officer*

*Acting Commissioner of Patents and Trademarks*